US007150844B2

(12) United States Patent
Deeman et al.

(10) Patent No.: US 7,150,844 B2
(45) Date of Patent: Dec. 19, 2006

(54) DRY PASSIVATION PROCESS FOR STAMPER/IMPRINTER FAMILY MAKING FOR PATTERNED RECORDING MEDIA

(75) Inventors: Neil N. Deeman, Alamo, CA (US); Hong Ying Wang, Fremont, CA (US); Gennady Gauzner, Livermore, CA (US); Nobuo Kurataka, Campbell, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 419 days.

(21) Appl. No.: 10/685,462

(22) Filed: Oct. 16, 2003

(65) Prior Publication Data

US 2005/0082700 A1 Apr. 21, 2005

(51) Int. Cl.
*B29C 33/42* (2006.01)
*C25D 1/10* (2006.01)

(52) U.S. Cl. ..... 264/220; 205/70; 264/2.5; 264/219; 264/338; 427/532; 427/533

(58) Field of Classification Search ..... 264/219, 264/220, 338, 2.5; 216/54; 427/533, 532; 204/192.1; 205/70
See application file for complete search history.

(56) References Cited

U.S. PATENT DOCUMENTS 4,948,703 A 8/1990 Falcone et al.
5,112,025 A * 5/1992 Nakayama et al. ..... 249/115
5,230,990 A * 7/1993 Iwasaki et al. ..... 430/321
5,772,905 A 6/1998 Chou
6,168,845 B1 1/2001 Fontana, Jr. et al.
6,544,430 B1 * 4/2003 McCormack et al. ..... 216/67
6,808,646 B1 * 10/2004 Jeans ..... 216/54

* cited by examiner

*Primary Examiner*—Allan R. Kuhns
(74) *Attorney, Agent, or Firm*—McDermott Will & Emery LLP

(57) ABSTRACT

A method of manufacturing a stamper/imprinter for use in patterning of a recording medium comprises sequential steps of:

(a) providing a substrate/workpiece comprising a topographically patterned surface including a plurality of projections and depressions corresponding to a pattern to be formed in a surface of the recording medium;

(b) forming a thin release layer in conformal contact with the topographically patterned surface by means of a dry process;

(c) forming a thicker layer of a material in conformal contact with the thin passivation layer on the topographically patterned surface; and (d) separating the thicker layer of material from the topographically patterned surface to form therefrom a stamper/imprinter including an imprinting surface having a negative image replica of the topographically patterned surface, separation of the thicker layer of material from the topographically patterned surface being facilitated by the thin release layer formed by the dry process.

18 Claims, 6 Drawing Sheets

DRY PASSIVATION PROCESS FOR STAMPER/IMPRINTER FAMILY MAKING FOR PATTERNED RECORDING MEDIA

FIELD OF THE INVENTION

The present invention relates to a method for reliably manufacturing stampers/imprinters utilized for rapid, cost-effective patterning of a layer or body of a recording medium. The invention has particular utility in the formation of patterns, e.g., servo patterns, in the surfaces of recording layers of data/information storage and retrieval media, e.g., hard disks.

BACKGROUND OF THE INVENTION

Recording media of various types, e.g., magnetic, optical, magneto-optical ("MO"), read-only memory ("ROM"), readable compact disks ("CD-R"), and readable-writable compact disks ("CD-RW") are widely used in various applications, e.g., in hard disk form, particularly in the computer industry for storage and retrieval of large amounts of data/information. Typically, such media types require pattern formation in the major surface(s) thereof for facilitating operation thereof. For example, magnetic and magneto-optical (MO) recording disks require formation of servo patterns for positioning the read-write transducer over a particular band or region of the media; ROM disks require formation of memory patterns therein; and CD-R and CD-RW disks require formation of wobble groove patterns therein.

Magnetic and magneto-optical (MO) recording media are conventionally fabricated in thin film form; the former are generally classified as "longitudinal" or "perpendicular", depending upon the orientation (i.e., parallel or perpendicular) of the magnetic domains of the grains of the magnetic material constituting the active magnetic recording layer, relative to the surface of the layer.

In operation of magnetic media, the magnetic layer is locally magnetized by a write transducer or write head to record and store data/information. The write transducer creates a highly concentrated magnetic field which alternates direction based on the bits of information being stored. When the local magnetic field applied by the write transducer is greater than the coercivity of the recording medium layer, then the grains of the polycrystalline magnetic layer at that location are magnetized. The grains retain their magnetization after the magnetic field applied by the write transducer is removed. The direction of the magnetization matches the direction of the applied magnetic field. The pattern of magnetization of the recording medium can subsequently produce an electrical response in a read transducer, allowing the stored medium to be read.

A typical contact start/stop (CSS) method employed during use of disk-shaped recording media, such as the above-described thin-film magnetic recording media, involves a floating transducer head gliding at a predetermined distance from the surface of the disk due to dynamic pressure effects caused by air flow generated between mutually sliding surfaces of the transducer head and the disk. During reading and recording (writing) operations, the transducer head is maintained at a controlled distance from the recording surface, supported on a bearing of air as the disk rotates, such that the transducer head is freely movable in both the circumferential and radial directions, thereby allowing data to be recorded and retrieved from the disk at a desired position in a data zone.

Adverting to FIG. 1, shown therein, in simplified, schematic plan view, is a magnetic recording disk 30 (of either longitudinal or perpendicular type) having a data zone 34 including a plurality of servo tracks, and a contact start/stop (CSS) zone 32. A servo pattern 40 is formed within the data zone 34, and includes a number of data track zones 38 separated by servo tracking zones 36. The data storage function of disk 30 is confined to the data track zones 38, while servo tracking zones 36 provide information to the disk drive which allows a read/write head to maintain alignment on the individual, tightly-spaced data tracks.

Although only a relatively few of the servo tracking zones are shown in FIG. 1 for illustrative simplicity, it should be recognized that the track patterns of the media contemplated herein may include several hundreds of servo zones to improve head tracking during each rotation of the disk. In addition, the servo tracking zones need not be straight radial zones as shown in the figure, but may instead comprise arcs, intermittent zones, partial spirals, or irregularly-shaped zones separating individual data tracks.

In conventional hard disk drives, data is stored in terms of bits along the data tracks. In operation, the disk is rotated at a relatively high speed, and the magnetic head assembly is mounted on the end of a support or actuator arm, which radially positions the head on the disk surface. If the actuator arm is held stationary, the magnetic head assembly will pass over a circular path on the disk, i.e., over a data track, and information can be read from or written to that track. Each concentric track has a unique radius, and reading and writing information from or to a specific track requires the magnetic head to be located above that track. By moving the actuator arm, the magnetic head assembly is moved radially on the disk surface between tracks. Many actuator arms are rotatable, wherein the magnetic head assembly is moved between tracks by activating a servomotor which pivots the actuator arm about an axis of rotation. Alternatively, a linear actuator may be used to move a magnetic head assembly radially inwardly or outwardly along a straight line.

As has been stated above, to record information on the disk, the transducer creates and applies a highly concentrated magnetic field in close proximity to the magnetic recording medium. During writing, the strength of the concentrated magnetic field directly under the write transducer is greater than the coercivity of the recording medium, and grains of the recording medium at that location are magnetized in a direction which matches the direction of the applied magnetic field. The grains of the recording medium retain their magnetization after the magnetic field is removed. As the disk rotates, the direction of the writing magnetic field is alternated, based on bits of the information being stored, thereby recording a magnetic pattern on the track directly under the write transducer.

On each track, eight "bits" typically form one "byte" and bytes of data are grouped as sectors. Reading or writing a sector requires knowledge of the physical location of the data in the data zone so that the servo-controller of the disk drive can accurately position the read/write head in the correct location at the correct time. Most disk drives use disks with embedded "servo patterns" of magnetically readable information. The servo patterns are read by the magnetic head assembly to inform the disk drive of track location. In conventional disk drives, tracks typically include both data sectors and servo patterns and each servo pattern typically includes radial indexing information, as well as a "servo burst". A servo burst is a centering pattern to precisely position the head over the center of the track. Because of the locational precision needed, writing of servo patterns requires expensive servo-pattern writing equipment and is a time consuming process.

Commonly assigned, co-pending U.S. patent application Ser. No. 10/082,178, filed Feb. 26, 2002 , the entire disclosure of which is incorporated herein by reference, discloses an improvement over the invention disclosed in commonly assigned U.S. Pat. No. 5,991,104, and is based upon the finding that very sharply defined magnetic transition patterns can be reliably, rapidly, and cost-effectively formed in a magnetic medium containing a longitudinal or perpendicular type magnetic recording layer without requiring expensive, complicated fabrication of a master disk.

Specifically, the invention disclosed in U.S. patent application Ser. No. 10/082,178 is based upon recognition that a stamper/imprinter (analogous to the aforementioned "master") comprised of a magnetic material having a high saturation magnetization, $B_{sat}$, i.e., $B_{sat} \geqq$ about 0.5 Tesla, and a high permeability, $\mu$, i.e., $\mu \geqq$ about 5, e.g., selected from Ni, NiFe, CoNiFe, CoSiFe, CoFe, and CoFeV, can be effectively utilized as a contact "stamper/imprinter" for contact "imprinting" of a magnetic transition pattern, e.g., a servo pattern, in the surface of a magnetic recording layer of a magnetic medium ("workpiece"), whether of longitudinal or perpendicular type. A key feature of this invention is the use of a stamper/imprinter having an imprinting surface including a topographical pattern, i.e., comprised of projections and depressions, corresponding to a desired magnetic transition pattern, e.g., a servo pattern, to be formed in the magnetic recording layer. An advantage afforded by the invention is the ability to fabricate the topographically patterned imprinting surface of the stamper/imprinter, as well as the substrate or body therefor, of a single material, as by use of well-known and economical electroforming techniques (described below in more detail).

According to this invention, the magnetic domains of the magnetic recording layer of the workpiece are first unidirectionally aligned (i.e., "erased" or "initialized"), as by application of a first external, unidirectional magnetic field $H_{initial}$ of first direction and high strength greater than the saturation field of the magnetic recording layer, typically $\geqq$2,000 and up to about 20,000 Oe. The imprinting surface of the stamper/imprinter is then brought into intimate (i.e., touching) contact with the surface of the magnetic recording layer. With the assistance of a second externally applied magnetic field of second, opposite direction and lower but appropriate strength $H_{re\text{-}align}$, determined by $B_{sat}/\mu$ of the stamper material (typically $\geqq$100 Oe, e.g., from about 2,000 to about 4,500 Oe), the alignment of the magnetic domains at the areas of contact between the projections of the imprinting surface of the stamper/imprinter (in the case of perpendicular recording media, as schematically illustrated in FIG. 2) or at the areas facing the depressions of the imprinting surface of the stamper/imprinter (in the case of longitudinal recording media, as schematically illustrated in FIG. 3) and the magnetic recording layer of the workpiece is selectively reversed, while the alignment of the magnetic domains at the non-contacting areas (defined by the depressions in the imprinting surface of the stamper/imprinter) or at the contacting areas, respectively, is unaffected, whereby a sharply defined magnetic transition pattern is created within the magnetic recording layer of the workpiece to be patterned which essentially mimics the topographical pattern of projections and depressions of the imprinting surface. According to the invention, high $B_{sat}$ and high $\mu$ materials are preferred for use as the stamper/imprinter in order to: (1) avoid early magnetic saturation of the stamper/imprinter at the contact points between the projections of the imprinting surface and the magnetic recording layer, and (2) provide an easy path for the magnetic flux lines which enter and/or exit at the side edges of the projections.

Another process which has been recently studied and developed as a low cost alternative technique for fine dimension pattern/feature formation in a substrate surface is thermal imprint lithography. A typical thermal imprint lithographic process for forming nano-dimensioned patterns/features in a substrate surface is illustrated with reference to the schematic, cross-sectional views of FIGS. 4(A)–4(D).

Referring to FIG. 4(A), shown therein is a stamper/imprinter 10 including a main (or support) body 12 having upper and lower opposed surfaces, with an imprinting layer 14 formed on the lower opposed surface. As illustrated, stamper/imprinter 14 includes a plurality of features 16 having a desired shape or surface contour. A workpiece 18 carrying a thin film layer 20 on an upper surface thereof is positioned below, and in facing relation to the molding layer 14. Thin film layer 20, e.g., of polymethylmethacrylate (PMMA), may be formed on the substrate/workpiece surface by any appropriate technique, e.g., spin coating.

Adverting to FIG. 4(B), shown therein is a compressive molding step, wherein stamper/imprinter 10 is pressed into the thin film layer 20 in the direction shown by arrow 22, so as to form depressed, i.e., compressed, regions 24. In the illustrated embodiment, features 16 of the imprinting layer 14 are not pressed all of the way into the thin film layer 20 and thus do not contact the surface of the underlying substrate 18. However, the top surface portions 24*a* of thin film 20 may contact depressed surface portions 16*a* of imprinting layer 14. As a consequence, the top surface portions 24*a* substantially conform to the shape of the depressed surface portions 16*a*, for example, flat. When contact between the depressed surface portions 16*a* of imprinting layer 14 and thin film layer 20 occurs, further movement of the imprinting layer 14 into the thin film layer 20 stops, due to the sudden increase in contact area, leading to a decrease in compressive pressure when the compressive force is constant.

FIG. 4(C) shows the cross-sectional surface contour of the thin film layer 20 following removal of stamper/imprinter 10. The imprinted thin film layer 20 includes a plurality of recesses formed at compressed regions 24 which generally conform to the shape or surface contour of features 16 of the molding layer 14. Referring to FIG. 4(D), in a next step, the surface-imprinted workpiece is subjected to processing to remove the compressed portions 24 of thin film 20 to selectively expose portions 28 of the underlying substrate 18 separated by raised features 26. Selective removal of the compressed portions 24 may be accomplished by any appropriate process, e.g., reactive ion etching (RIE) or wet chemical etching.

The above-described imprint lithographic processing is capable of providing sub-micron-dimensioned features, as by utilizing a stamper/imprinter 10 provided with patterned features 16 comprising pillars, holes, trenches, etc., by means of e-beam lithography, RIE, or other appropriate patterning method. Typical depths of features 16 range from about 5 to about 200 nm, depending upon the desired lateral dimension. The material of the imprinting layer 14 is typically selected to be hard relative to the thin film layer 20, the latter comprising a thermoplastic material which is softened when heated. Thus, suitable materials for use as the imprinting layer 14 include metals, dielectrics, semiconductors, ceramics, and composite materials. Suitable materials for use as thin film layer 20 include thermoplastic polymers which can be heated to above their glass temperature, $T_g$, such that the material exhibits low viscosity and enhanced flow.

Referring now to FIG. 5, schematically illustrated therein, in simplified cross-sectional view, is a sequence of processing steps for performing nano-imprint lithography of a metal-based workpiece, e.g., a disk-shaped substrate for a hard disk recording medium, utilizing a stamper/imprinter with a lubricated imprinting surface, as disclosed in commonly assigned, co-pending U.S. patent application Ser. No. 09/946,939, filed Sep. 5, 2001, the entire disclosure of which is incorporated herein by reference.

In a preliminary step according to the method, a thin film of a thermoplastic polymer, e.g., polymethylmethacrylate (PMMA), is spin-coated on the substrate surface. In another preliminary step, a stamper/imprinter, e.g., formed of Ni, having an imprinting surface with a negative image of servo pattern features having a lateral dimension of about 600 nm and a height of 170 nm is fabricated by conventional optical lithographic patterning/etching techniques and provided with a thin layer of an anti-sticking or release agent. In the next steps according to the disclosed invention, the system of substrate/workpiece and Ni-based stamper/imprinter is heated to above the glass transition temperature ($T_g$) of the PMMA, i.e., above about 105° C., and the negative image of the desired pattern on the imprinting surface of the stamper/imprinter is embossed into the surface of the thermoplastic PMMA layer at a pressure of about 10 MPa. The stamper/imprinter is then maintained in contact with the PMMA layer and under pressure until the system cools down to about 70° C., and then removed from the substrate/workpiece to leave replicated features of the imprinting surface in the surface of the PMMA layer. Subsequent processing of the imprinted substrate/workpiece involves selective removal of substrate material utilizing the imprinted layer of thermoplastic material as a pattern defining (etching) mask, followed by removal of the imprinted layer of thermoplastic material.

Still another process which has been recently studied and developed as a low cost alternative technique for fine dimension pattern/feature formation in a substrate surface is imprinting of a sol-gel layer on a substrate surface, as for example, disclosed in commonly assigned, co-pending U.S. patent application Ser. No. 09/852,084, filed May 10, 2001, the entire disclosure of which is incorporated herein by reference.

According to the process disclosed therein, problems attendant upon the use of very hard surfaced, high modulus materials, e.g., of glass, ceramics, or glass-ceramic composites, as substrates in the manufacture of hard disk recording media are addressed, and the invention is based upon the discovery that the surfaces of such materials may be modified, i.e., reduced in hardness, so as to facilitate formation of servo patterns therein, as by a simple and conveniently performed embossing process. According to the invention, modification (i.e., reduction) of surface hardness of high modulus substrates for use in the manufacture of thin film recording media is obtained by first forming a relatively soft sol-gel coating layer on the substrate surface, embossing the desired servo pattern in the exposed upper surface of the relatively soft sol-gel layer utilizing a stamper/imprinter with an appropriately patterned imprinting surface comprising a patterned plurality of depressions and protrusions having a negative image of the desired servo pattern, and then converting the embossed, relatively soft sol-gel layer to a relatively hard glass-like layer while retaining the embossed servo pattern therein. The thus-formed substrate with embossed servo pattern in the exposed surface thereof is then subjected to thin film deposition thereon for forming the layer stack constituting the magnetic recording medium. The inventive methodology advantageously provides servo-patterned recording media without requiring servo-writing subsequent to media fabrication.

Stampers/imprinters for use in a typical application, e.g., servo pattern formation in the recording layer of a disk-shaped, thin film, longitudinal or perpendicular magnetic recording medium, comprise an imprinting surface having topographical features consisting of larger area data zones separated by smaller areas with well-defined patterns of projections and depressions corresponding to conventionally configured servo sectors, as for example, disclosed in the aforementioned commonly assigned U.S. Pat. No. 5,991,104. For example, a suitable topography for forming the servo sectors may comprise a plurality of projections having a height in the range from about 20 to about 500 nm, a width in the range from about 0.01 to about 1 μm, and a spacing of at least about 0.01 μm.

Stampers/imprinters suitable for use in performing the foregoing patterning processes may be manufactured by a sequence of steps as schematically illustrated in FIG. 6, which steps include providing a "master" comprised of a substantially rigid substrate with a patterned layer of a resist material thereon, the pattern, which is formed in the resist layer by conventional lithographic techniques, including, e.g., e-beam or laser beam exposure of selected areas of the resist, comprising a plurality of projections and depressions corresponding (in positive or negative image form, as necessary) to the desired pattern, e.g., a servo pattern, to be formed in the surface of the stamper/imprinter. Stampers/imprinters are made from the "master" by initially forming a thin, conformal layer of an electrically conductive material (e.g., Ni) over the patterned resist layer and then electroforming a substantially thicker ("blanket") metal layer (e.g., Ni in the case of magnetic stampers/imprinters) on the thin layer of electrically conductive material, which electroformed blanket layer replicates the surface topography of the resist layer. Upon completion of the electroforming process, the stamper/imprinter is separated from the "master".

In practice, however, since the "master" with fragile resist layer thereon is effectively destroyed upon separation of the stamper/imprinter from the "master", a process has been developed involving forming a "family" of stampers/imprinters, as schematically illustrated in FIG. 7. As shown in the figure, the stamper/imprinter formed directly from the "master" is termed a "father" and has a reverse (i.e., negative) replica of the topographical pattern of the "master". The "father" is then utilized for forming several (illustratively two) "mothers" therefrom (e.g., as by a process comprising electroforming, as described above), and each "mother" is in turn utilized for forming several (illustratively two, for a total of four) "sons" therefrom (also by a process comprising electroforming). The "sons" are positive replicas of the "father" and are utilized as the stampers/imprinters for media patterning. Since, as described above, the "master" is effectively destroyed in the process of making the "father" therefrom, the "family" making process avoids the need for repeatedly manufacturing "master" stampers/imprinters by preserving the "father" and utilizing the "sons". Therefore, process time and cost of making "masters" is substantially reduced by means of the "family" making process.

The thus-formed "sons" are then subjected to further processing for forming stampers/imprinters with a desired dimension (i.e., size) and geometrical shape or contour, e.g., an annular disk-shaped stamper/imprinter for use in patterning of annular disk-shaped media such as hard disks, which stampers/imprinters necessarily include a circularly-shaped central aperture defining an inner diameter ("ID") and a circularly-shaped periphery defining an outer diameter ("OD").

The "family" making process, as described supra, is made possible/practical only if the "mothers" are readily separated from the "father" without incurring damage to the patterned surface(s), and the "sons" are similarly readily separated from the "mothers" without incurring damage to the patterned surface(s). As a consequence, the patterned surfaces of the "father" and the "mothers" are each provided with a coating layer of a material, termed a "release" layer and typically comprised of a passivating material, prior to formation of the respective "mothers" and "sons", for facilitating separation, i.e., "release", of the "mothers" from the "father" and the "sons" from the "mothers".

A typical method for forming the release layer, such as when at least the imprinting surface of the stamper/imprinter is comprised of a metal or alloy, e.g., a magnetic metal or alloy, such as Ni or a Ni-based alloy, involves formation of a thin layer of a passivating oxide of the metal or metal alloy on the imprinting surface of the "father" and the "mothers" by means of a "wet" process, such as, for example, electrochemical anodization or application of an oxidizing solution. Electrochemical anodization of the Ni or Ni-based alloys utilized in the formation of magnetic stampers/imprinters is typically performed utilizing an alkaline aqueous solution of tri-sodium phosphate ($Na_3PO_4$). However, the "wet" process of electrochemical anodization for forming passivating oxides for use as release layers is disadvantageous in that it: (1) is a source of defect generation in the topographical pattern of the imprinting surface; and (2) is incompatible with the other, i.e., "dry", processes utilized for manufacture of the stampers/imprinters, such as the sputtering processing utilized for forming thin metal layers on the patterned surfaces prior to the electroforming step.

In view of the foregoing problems, drawbacks, and disadvantages attendant upon the use of conventional "wet" processing techniques, e.g., electrochemical anodization, for forming passivation layers on the imprinting surfaces of the "father" and "mothers" to facilitate separation of the respective "mothers" and "sons" therefrom in a "family" making process for manufacturing stampers/imprinters for use in patterning of recording media, there exists a need for methodologies for manufacturing a "family" of stampers/imprinters which are free of the above-described problems, drawbacks, and disadvantages associated with the use of wet techniques for the formation of passivation layers utilized for facilitating release or separation of the "mothers" and "sons" from the respective "father" and "mothers". Moreover, there exists a need for methodologies which facilitate rapid, reliable, and cost-effective manufacture of "families" of stampers/imprinters for use in rapid, reliable, accurate, and cost-effective patterning of a variety of types of recording media including, but not limited to, formation of servo patterns in magnetic and magneto-optical (MO) recording media.

The present invention addresses and solves the aforementioned problems, drawbacks, and disadvantages associated with the use of conventional wet techniques for the formation of passivation layers utilized for facilitating release or separation of the "mothers" and "sons" from the respective "father" and "mothers", while maintaining full compatibility with the requirements of automated manufacturing technology.

DISCLOSURE OF THE INVENTION

An advantage of the present invention is an improved method of manufacturing a stamper/imprinter for use in patterning of a recording medium.

Another advantage of the present invention is an improved method of manufacturing a plurality of stampers/imprinters for use in contact patterning of a magnetic recording medium.

Additional advantages and other features of the present invention will be set forth in the description which follows and in part will become apparent to those having ordinary skill in the art upon examination of the following or may be learned from the practice of the present invention. The advantages of the present invention may be realized as particularly pointed out in the appended claims.

According to an aspect of the present invention, the foregoing and other advantages are obtained in part by an improved method of manufacturing a stamper/imprinter for use in patterning of a recording medium, comprising sequential steps of:

(a) providing a substrate/workpiece comprising a topographically patterned surface including a plurality of projections and depressions corresponding to a pattern to be formed in a surface of a recording medium;

(b) forming a thin release layer in conformal contact with the topographically patterned surface by means of a dry process;

(c) forming (e.g., by electroforming) a thicker layer of a material in conformal contact with the thin release layer on the topographically patterned surface; and (d) separating the thicker layer of material from the topographically patterned surface to form therefrom a stamper/imprinter including an imprinting surface having a negative image replica of the topographically patterned surface, separation of the thicker layer of material from the topographically patterned surface being facilitated by the thin release layer formed by the dry process.

According to embodiments of the present invention, step (a) comprises providing a substrate/workpiece wherein the topographical pattern corresponds to a magnetic pattern including a servo pattern for a magnetic or magneto-optical (MO) recording medium, a read-only memory (ROM) pattern, or a wobble groove pattern for a readable compact disk (CD-R) or a readable-writable compact disk (CD-RW).

Preferred embodiments of the invention include those wherein step (a) comprises providing a substrate/workpiece wherein the topographical pattern corresponds to a magnetic pattern including a servo pattern for a magnetic or magneto-optical (MO) recording medium, in which instance step (a) comprises providing a substrate/workpiece wherein at least the topographically patterned surface is comprised of at least one magnetic material having a high saturation magnetization $B_{sat} \geqq 0.5$ Tesla and a high permeability $\mu \geqq \sim 5$; step (b) comprises forming at least one passivating oxide of the at least one magnetic material as said the release layer, e.g., step (b) comprises forming at least one passivating oxide as a thin release layer from about 50 to about 200 Å thick; and step (c) comprises forming a layer of at least one magnetic material having a high saturation magnetization $B_{sat} \geqq 0.5$ Tesla and a high permeability $\mu \geqq \sim 5$ as the thicker layer.

According to embodiments of the present invention, step (b) comprises forming the at least one passivating oxide by thermal oxidation of the at least one magnetic material in an $O_2$-containing atmosphere.

Preferred embodiments of the present invention include those wherein step (b) comprises forming the at least one passivating oxide by means of a plasma; as when step (b) comprises treating the topographically patterned surface with an oxygen ($O_2$) plasma under conditions selected for minimizing deformation and/or degradation of the pattern and for an interval sufficient for facilitating release of the thicker layer of at least one magnetic material therefrom in step (d).

According to alternative preferred embodiments of the present invention, step (b) comprises forming the at least one passivating oxide by means of a DC, RF, or microwave plasma, or a combination thereof; e.g., step (b) comprises exposing the topographically patterned surface to an oxygen ($O_2$) plasma, under conditions selected for minimizing deformation and/or degradation of the pattern and for an interval sufficient for facilitating release of the thicker layer of at least one magnetic material therefrom.

In accordance with particularly preferred embodiments of the present invention, step (a) comprises providing a substrate/workpiece comprising at least one magnetic material selected from the group consisting of: Ni, NiFe, CoNiFe, CoSiFe, CoFe, and CoFeV; step (b) comprises forming the thin release layer as comprising at least one passivating oxide of at least one magnetic material selected from the group consisting of Ni, NiFe, CoNiFe, CoSiFe, CoFe, and CoFeV; step (c) comprises forming a layer comprising at least one magnetic material selected from the group consisting of: Ni, NiFe, CoNiFe, CoSiFe, CoFe, and CoFeV as the thicker layer; and step (d) comprises separating the thicker layer of at least one magnetic material from the topographically patterned surface to form therefrom a magnetic stamper/imprinter including an imprinting surface having a negative image replica of the topographically patterned surface, the magnetic stamper/imprinter being usable for contact patterning of magnetic recording media; wherein step (b) comprises treating said topographically patterned surface of said substrate/workpiece with an oxygen ($O_2$) plasma under conditions selected for minimizing deformation and/or degradation of said pattern and for an interval sufficient for facilitating release of said thicker layer of at least one magnetic material therefrom.

Further preferred embodiments of the present invention include those wherein the method further comprises repeating steps (a)–(d) at least once, utilizing the same substrate/workpiece provided in step (a), to form at least one additional stamper/imprinter therefrom, or utilizing the stamper/imprinter formed in step (d) as the substrate/workpiece for performing a sequence of steps (a)–(d) for manufacturing at least one additional stamper/imprinter therefrom.

Another aspect of the present invention is a method of manufacturing a plurality of stampers/imprinters for use in contact patterning of a magnetic recording medium, comprising sequential steps of:

(a) providing a first stamper/imprinter comprising a topographically patterned surface including a plurality of projections and depressions corresponding to a magnetic pattern including a servo pattern to be formed in a surface of a recording medium, the topographically patterned surface comprised of at least one magnetic material having a high saturation magnetization $B_{sat} \geqq 0.5$ Tesla and a high permeability $\mu \geqq \sim 5$, selected from the group consisting of: Ni, NiFe, CoNiFe, CoSiFe, CoFe, and CoFeV;

(b) forming a thin release layer, from about 50 to about 200 Å thick, in conformal contact with the topographically patterned surface by means of a dry process, said thin release layer comprising at least one passivating oxide of at least one magnetic material selected from the group consisting of Ni, NiFe, CoNiFe, CoSiFe, CoFe, and CoFeV; and (c) forming a thicker layer of at least one magnetic material in conformal contact with the thin release layer, the thicker layer comprised of at least one magnetic material having a high saturation magnetization $B_{sat} \geqq 0.5$ Tesla and a high permeability $\mu \geqq \sim 5$, selected from the group consisting of: Ni, NiFe, CoNiFe, CoSiFe, CoFe, and CoFeV;

(d) separating the thicker layer of at least one magnetic material from the topographically patterned surface to form therefrom a second stamper/imprinter including an imprinting surface having a negative image replica of the topographically patterned surface, separation of the thicker layer of at least one magnetic material from the topographically patterned surface being facilitated by the thin release layer formed by the dry process, wherein:

the first stamper/imprinter is a "father" and the second stamper/imprinter is a "mother", or the first stamper/imprinter is a "mother" and the second stamper/imprinter is a "son".

According to preferred embodiments of the invention, step (b) comprises treating the topographically patterned surface with an oxygen ($O_2$) plasma to form the thin release layer under conditions selected for minimizing deformation and/or degradation of the pattern and for an interval sufficient for facilitating release of the thicker layer of material therefrom in step (d); and the method further comprises repeating steps (a)–(d) at least once, utilizing the "father" or "mother" provided in step (a) as the first stamper/imprinter, to form at least one additional "mother" or "son" therefrom, or utilizing a "mother" stamper/imprinter formed in step (d) as the first stamper/imprinter for performing a sequence of steps (a)–(d) for manufacturing at least one "son" stamper/imprinter therefrom.

Additional advantages and aspects of the present invention will become readily apparent to those skilled in the art from the following detailed description, wherein embodiments of the present invention are shown and described, simply by way of illustration of the best mode contemplated for practicing the present invention. As will be described, the present invention is capable of other and different embodiments, and its several details are susceptible of modification in various obvious respects, all without departing from the spirit of the present invention. Accordingly, the drawings and description are to be regarded as illustrative in nature, and not as limitative.

BRIEF DESCRIPTION OF THE DRAWINGS

The following detailed description of the embodiments of the present invention can best be understood when read in conjunction with the following drawings, in which the various features are not necessarily drawn to scale but rather are drawn as to best illustrate the pertinent features, wherein.

DESCRIPTION OF THE INVENTION

Figure 1:
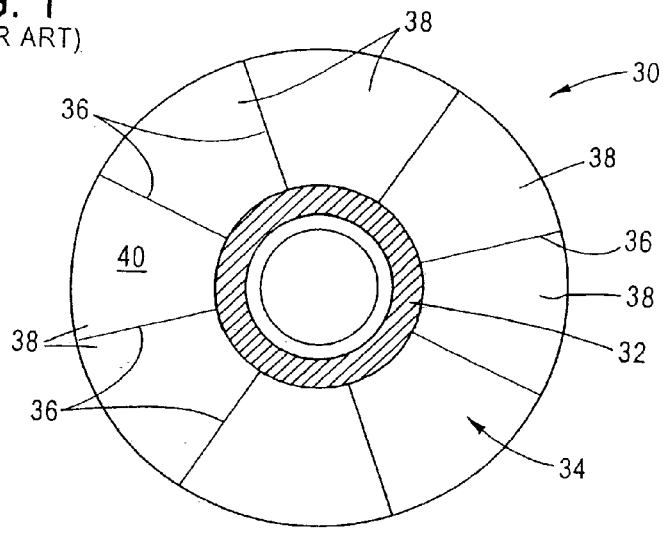
FIG. 1 (PRIOR ART)
FIG. 1 illustrates, in simplified, schematic plan view, a magnetic recording disk designating the data, servo pattern, and CSS zones thereof.
Figure 2:
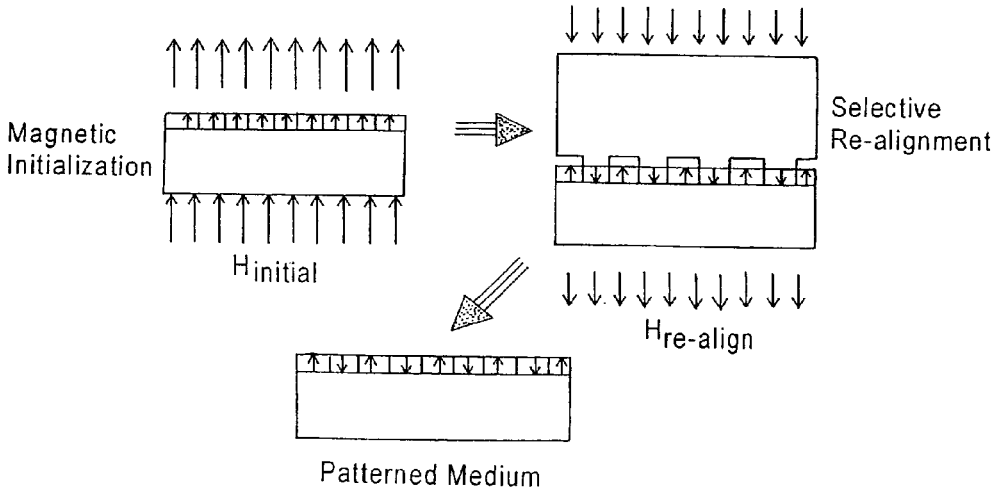
FIG. 2 illustrates, in schematic, simplified cross-sectional view, a sequence of process steps for contact printing a magnetic transition pattern in the surface of a perpendicular magnetic recording layer, utilizing a stamper/imprinter formed of a high saturation magnetization, high permeability magnetic material having an imprinting surface with a surface topography corresponding to the desired magnetic transition pattern.
Figure 3:
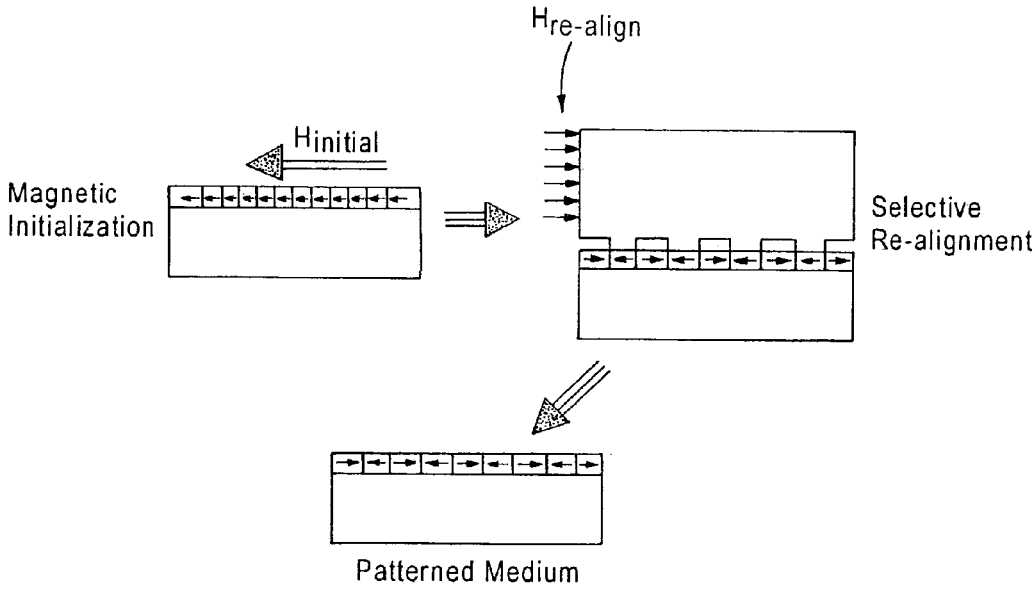
FIG. 3 illustrates, in schematic, simplified cross-sectional view, a similar sequence of process steps for contact printing a magnetic transition pattern in the surface of a longitudinal magnetic recording layer.
Figure 4A:
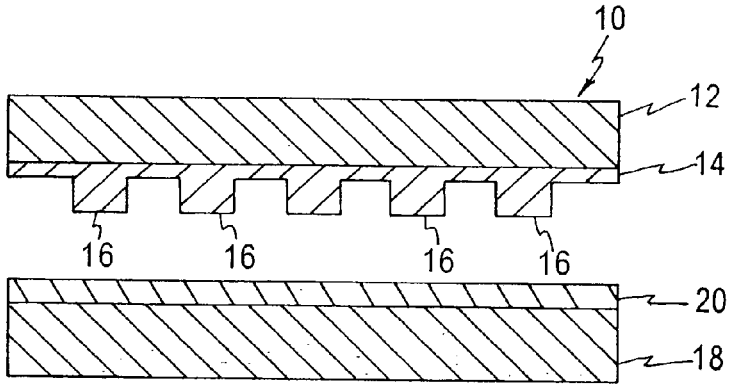
FIG. 4A (PRIOR ART)
FIGS. 4(A)–4(D) illustrate, in simplified cross-sectional view, a process sequence for performing thermal imprint lithography of a thin resist film on a substrate (workpiece), according to the conventional art.
Figure 4B:
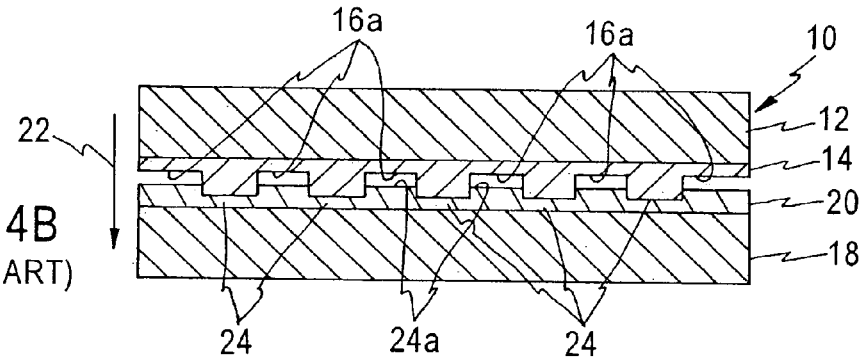
FIG. 4B (PRIOR ART)
Figure 4C:
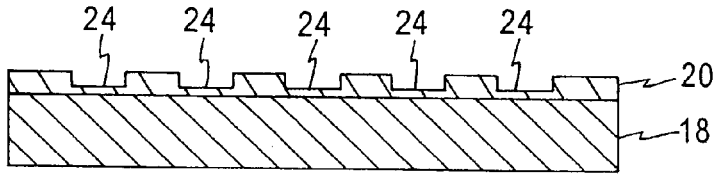
FIG. 4C (PRIOR ART)
Figure 4D:
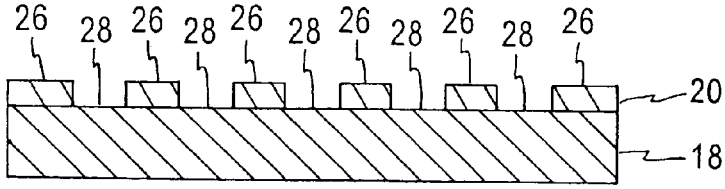
FIG. 4D (PRIOR ART)
Figure 5:
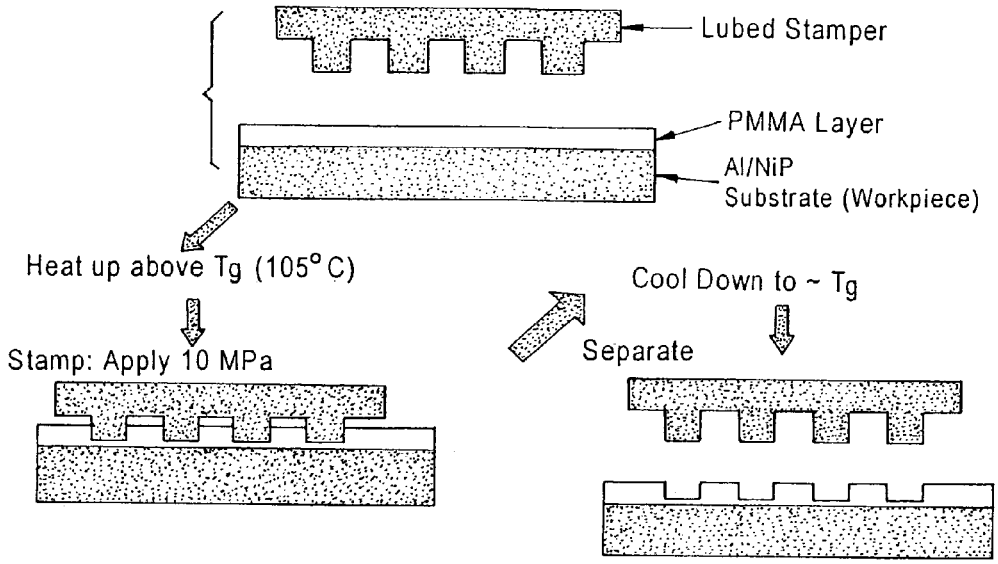
FIG. 5 schematically illustrates, in simplified cross-sectional view, another sequence of steps for performing imprint lithography of a resist film.
Figure 6:
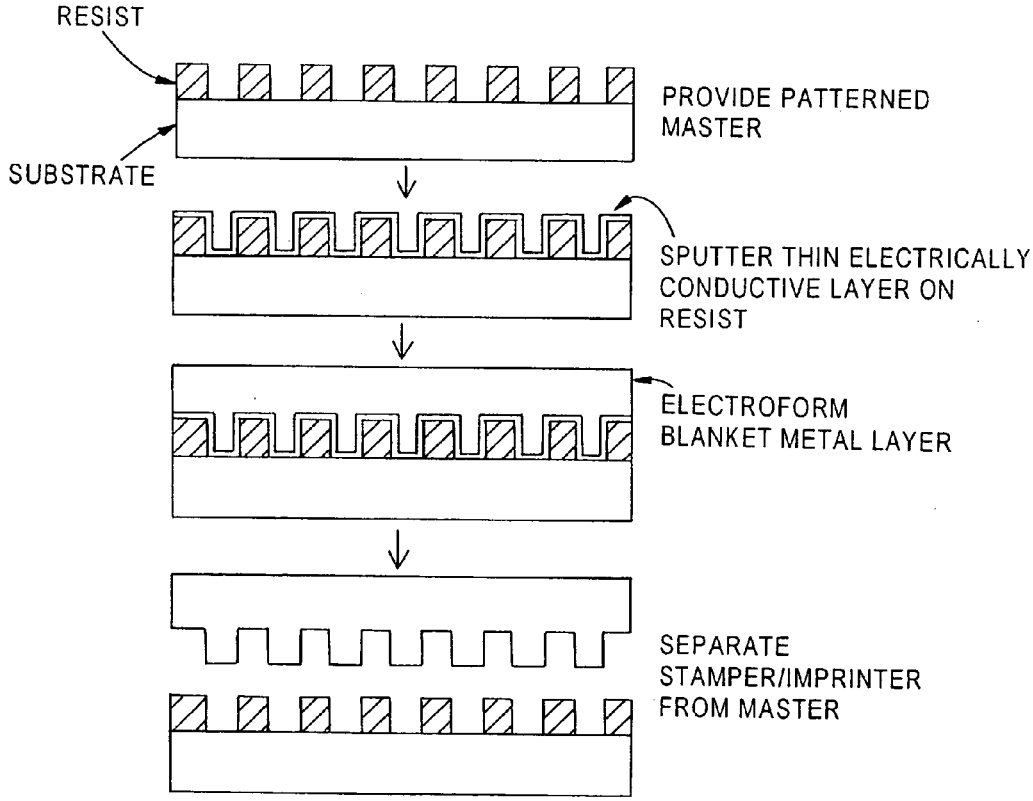
FIG. 6 schematically illustrates, in simplified cross-sectional view, a sequence of steps for forming a stamper/imprinter for recording media patterning.

The present invention addresses and solves problems, disadvantages, and drawbacks attendant upon the formation of "families" of stampers/imprinters, e.g., magnetic stampers/imprinters for use in rapidly and cost-effectively performing servo patterning of magnetic recording media (e.g., hard disks) by contact patterning, by means of a fabrication process sequence wherein a "mother" stamper/imprinter is initially formed with a topographically patterned imprinting surface in conformal contact with a similarly topographically patterned surface of a "father" stamper/imprinter and subsequently separated therefrom, or a "son" stamper/imprinter is initially formed with a topographically patterned imprinting surface in conformal contact with a similarly topographically patterned surface of a "mother" stamper/imprinter and subsequently separated therefrom, followed by utilization of the resultant stampers/imprinters for forming servo patterns in the surfaces of magnetic recording media by contact patterning, as described supra.

Specifically, the present invention eliminates problems, disadvantages, and drawbacks associated with the use of "wet" processing techniques, such as electrochemical anodization or treatment with an oxidizing solution, for forming thin, metal oxide passivation/release coating layers on the topographically patterned imprinting surfaces of the "father" or "mother" stampers/imprinters prior to formation of the respective "mother" or "son" stampers/imprinters in conformal contact therewith, which release layers facilitate separation and multiple re-use of the "father" and "mother" stampers/imprinters.

As indicated above, electrochemical anodization of the Ni or Ni-based alloys utilized in the formation of magnetic stampers/imprinters is typically performed utilizing an alkaline aqueous solution of tri-sodium phosphate ($Na_3PO_4$). However, the "wet" process of electrochemical anodization for forming passivating oxides for use as release layers is disadvantageous in that it: (1) is a source of defect generation in the topographical pattern of the imprinting surface; and (2) is incompatible with the other, i.e., "dry", processes utilized for manufacture of the stampers/imprinters, such as the sputtering processing utilized for forming thin metal layers on the patterned surfaces prior to the electroforming step.

According to preferred embodiments of the present, therefore, formation of the release layer on the topographically patterned (e.g., servo patterned) imprinting surfaces of stampers/imprinters, e.g., magnetic stampers/imprinters comprised of at least one magnetic metal or alloy (as enumerated above), is accomplished by means of a plasma, e.g., plasma oxidation utilizing an oxygen ($O_2$) plasma for forming a thin passivating oxide layer which functions as a release layer facilitating separation of the stampers/imprinters. Since a principal feature of the invention is oxidation of the topographically patterned imprinting surface of the stamper/imprinter, e.g., a Ni or Ni alloy surface, to form a Ni oxide or an oxide of the Ni alloy, an $O_2$ plasma process which differs from the $O_2$ plasma treatments typically utilized for material removal (i.e., etching) and cleaning, is utilized. More specifically, according to the inventive methodology, the $O_2$ plasma is very "soft" and gentle compared to the conventional $O_2$ plasmas, e.g., wherein the pressure $\geqq$200 mTorr and the power $\leqq$100 W, in order to avoid exposing the topographically patterned imprinting surfaces to a harsh environment capable of disadvantageously resulting in deformation and/or degradation of the pattern features.

Figure 7:
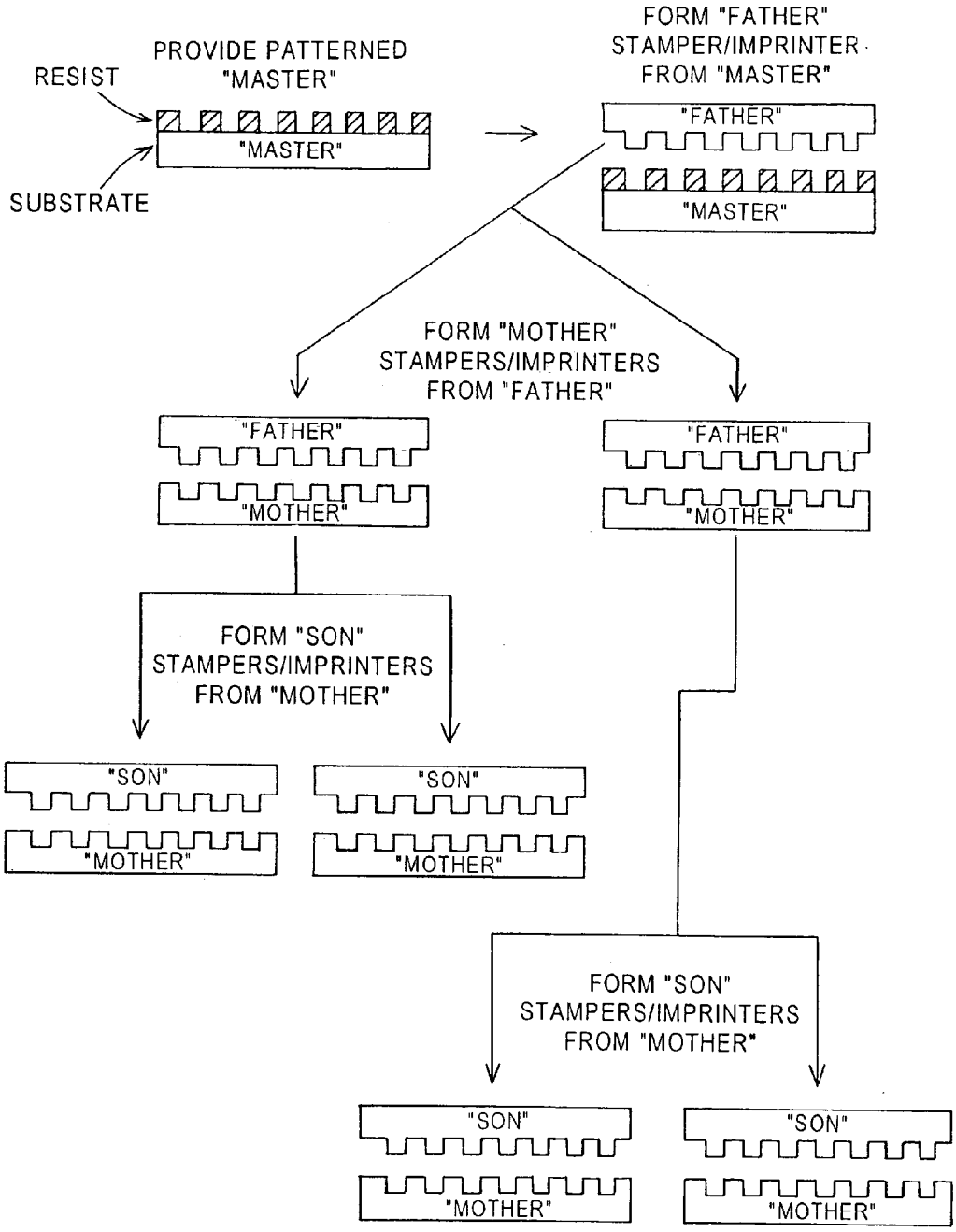
FIG. 7 is a schematic flow chart for illustrating a sequence of process steps for manufacturing a plurality of stampers/imprinters from a single "master"

According to the invention, after a "father" stamper/imprinter is separated from a "master", as at the beginning of a "family" making process, e.g., as schematically illustrated in FIG. 7 and described above, the topographically patterned imprinting surface of the "father" stamper/imprinter comprising a negative image replica of the topographically patterned surface of the "master" stamper/imprinter is subjected to a preliminary treatment with ozone ($O_3$) and UV irradiation for removing any resist residue from the "master".

Figure 8:
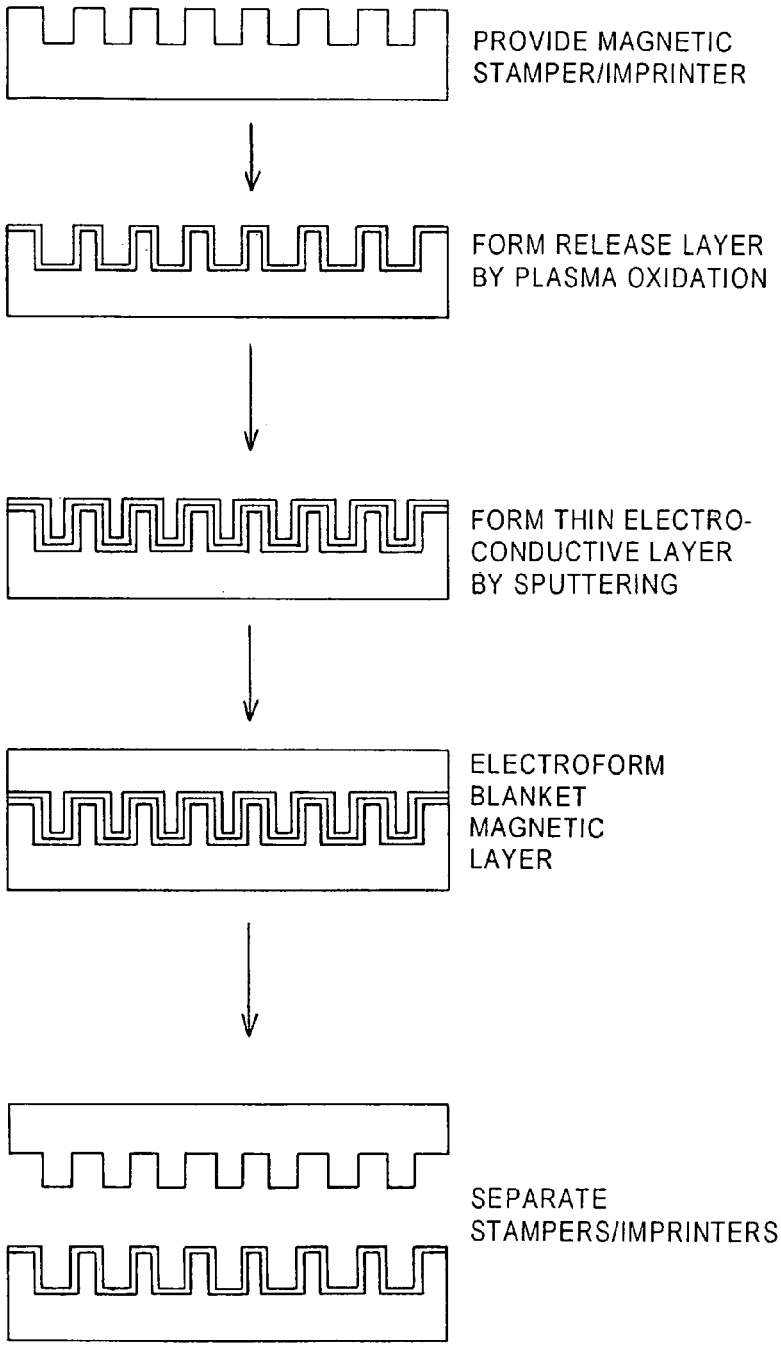
FIG. 8 schematically illustrates, in simplified cross-sectional view, a sequence of steps for forming a magnetic stamper/imprinter for use in contact patterning of magnetic recording media, according to the methodology of the present invention.

Referring to FIG. 8, which schematically illustrates, in simplified cross-sectional view, a sequence of steps for forming a magnetic stamper/imprinter for use in contact patterning of magnetic recording media, according to the inventive methodology, the $O_3$/UV treated "father" stamper/imprinter is then immediately treated with a soft and gentle $O_2$ plasma (wherein, as previously indicated, the pressure $\geqq$200 mTorr and the power $\leqq$100 W)), e.g., a DC, RF, or microwave plasma, or a combination thereof, for forming a thin (e.g., from about 50 to about 200 Å thick) layer of a passivating oxide as a release layer facilitating separation therefrom of a subsequently electroformed "mother" stamper/imprinter having an imprinting surface which is a negative image replica of the imprinting surface of the "father" stamper/imprinter. A similar $O_2$ plasma process, not necessarily requiring the preliminary $O_3$/UV treatment for residual resist removal, is performed on the "mother" stampers/imprinters prior to their use in fabricating "son" stampers/imprinters, as illustrated in FIG. 7. According to the invention, the topographically patterned imprinting surface of the stamper/imprinter is treated with the $O_2$ plasma under conditions selected for minimizing deformation and/or degradation of the pattern (e.g., a servo pattern) and for an interval sufficient for facilitating release of the "mother" or "son" from the respective "father" or "mother".

The $O_2$ plasma-treated imprinting surface of the stamper/imprinter is then subjected to sputtering of a thin, electrically conductive layer thereon, e.g., a Ni or Ni alloy layer, which thin, electrically conductive layer is necessary for effecting subsequent formation, by an electroforming process, of a thicker, mechanically robust "blanket" layer of a magnetic material, e.g., Ni or a Ni alloy, in conformal contact with the release layer-coated imprinting surface of the stamper/imprinter. After the "mother" or "son" is electroformed on the respective "father" or "mother", the "father"/"mother" or "mother"/"son" pair is removed from the electroforming bath, rinsed, and thoroughly dried before separation. The "mother" is then separated from the "father", or the "son" is separated from the "mother", utilizing the passivating oxide as a release layer for facilitating separation of the pairs of stampers/imprinters. In cases where the "father" or the "mother" stamper/imprinter is to be re-used for forming additional "mothers" and "sons", it is then immediately placed back into the apparatus (comprising interconnected vacuum chambers) for re-formation of the thin passivation/release layer on the topographically patterned imprinting surface by means of $O_2$ plasma treatment, followed by sputtering of the thin, electrically conductive layer and electroforming of the "blanket" layer. In this way, liquid contamination and defect generation of the $O_3$/UV and $O_2$ plasma-treated imprinting surfaces is effectively minimized.

The advantageous nature, features, and capabilities of the invention will now be illustrated by reference to the following non-limitative examples, wherein an Oxford RIE "Plasmalab 80 plus" apparatus was utilized for performing the $O_2$ plasma oxidation/passivation process for forming release layers. A pair of topographically patterned Ni-based "mother" stampers/imprinters (i.e., Nos. 1 and 2) and a Ni-based mirror-finished "mother" stamper/imprinter were treated with a soft and gentle $O_2$ plasma for different intervals to form a passivating oxide layer thereon for use as a release layer during subsequent formation of a "son" stamper/imprinter therefrom. A separation test was performed on each of the "mother"/"son" pairs after electroforming of the "blanket" layer. the results are given in Table I below.

TABLE I

| "Mother" stamper | $O_2$ plasma treatment | "Son" stamper separation |
|---|---|---|
| Patterned No. 1 | 2 min., 100 W, 200 mTorr, $O_2$ flow 50 sccm | Failed |
| Mirror-finished | 10 min., 100 W, 200 mTorr, $O_2$ flow 50 sccm | Successful |
| Patterned No. 2 | 10 min., 100 W, 200 mTorr, $O_2$ flow 50 sccm | Successful |

As is evident from the results presented in Table I, successful separation of the "son" stamper/imprinter from the "mother" stamper/imprinter (i.e., No. 2) occurred when the $O_2$ plasma treatment was of sufficient duration, i.e., ~10 min., as to cause formation of an effective oxide passivation/release layer.

Microscopic inspection of the imprinting surface of patterned "mother" stamper/imprinter No. 2 after separation therefrom of the "son" stamper/imprinter indicated essentially complete absence of pattern deformation, tearing, or debris formation. Results of Atomic Force Microscopy ("AFM") measurements of the topographically patterned imprinting surface of the "mother" stamper/imprinter No. 2 after the 10 min. $O_2$ plasma treatment are given in Table II below, which results indicate that the pattern features are very well preserved upon separation and no significant changes in the pattern occur as a result of the dry ($O_2$) plasma passivation process.

TABLE II

| | Before $O_2$ plasma treatment | After $O_2$ plasma treatment |
|---|---|---|
| Average depth | 97 nm | 97 nm |
| Average width | 159 nm | 156 nm |
| Average wall angle | 72° | 74° |

The present invention thus affords a number of significant advantages over previous processes for forming stampers/imprinters utilized for patterning various types of recording media, including, but not limited to, formation of servo patterns in magnetic recording layers, including the ability to form stampers/imprinters from larger-sized substrates/workpieces without damaging or otherwise compromising the quality of the topographical pattern.

It should be apparent to one of ordinary skill in the art that the present invention provides a significant improvement over the conventional art such as has been described above, particularly with respect to the ease and simplicity of manufacturing high replication fidelity stampers/imprinters for use in various types of media patterning processes. Further, the imprinting surface of the stampers/imprinters according to the invention can be formed with a wide variety of topographical patterns, whereby the inventive methodology can be rapidly, easily, and cost-effectively implemented in the automated manufacture of a number of articles, devices, etc., requiring patterning, of which servo patterning of longitudinal and perpendicular magnetic recording media merely constitute examples of the versatility and utility of the invention.

In the previous description, numerous specific details are set forth, such as specific materials, structures, processes, etc., in order to provide a better understanding of the present invention. However, the present invention can be practiced without resorting to the details specifically set forth. In other instances, well-known processing materials and techniques have not been described in detail in order not to unnecessarily obscure the present invention.

Only the preferred embodiments of the present invention and but a few examples of its versatility are shown and described in the present disclosure. It is to be understood that the present invention is capable of use in other combinations and environments and is susceptible of changes and/or modifications within the scope of the inventive concept as expressed herein.

What is claimed is:

1. A method of manufacturing a stamper/imprinter for use in patterning of a recording medium, comprising sequential steps of:

(a) providing a substrate/workpiece comprising a topographically patterned surface including a plurality of projections and depressions corresponding to a pattern to be formed in a surface of a said recording medium, wherein at least said topographically patterned surface is comprised of at least one magnetic material having a high saturation magnetization $B_{sat} \geqq 0.5$ Tesla and a high permeability $\mu \geqq \sim 5$;

(b) forming a thin release layer in conformal contact with said topographically patterned surface by means of a dry process, wherein said thin release layer is formed of at least one passivating oxide of said at least one magnetic material;

(c) forming a thicker layer of a material in conformal contact with said thin release layer on said topographically patterned surface, wherein said thicker layer is formed of at least one magnetic material having a high saturation magnetization $B_{sat} \geqq 0.5$ Tesla and a high permeability $\mu \geqq \sim 5$ as said thicker layer; and (d) separating said thicker layer of material from said topographically patterned surface to form therefrom a stamper/imprinter including an imprinting surface having a negative image replica of said topographically patterned surface, separation of said thicker layer of material from said topographically patterned surface being facilitated by said thin release layer formed by said dry process.

2. The method as in claim 1, wherein:

step (a) comprises providing a substrate/workpiece wherein said pattern corresponds to a magnetic pattern including a servo pattern for a magnetic or magneto-optical (MO) recording medium.

3. The method as in claim 1, wherein:

step (b) comprises forming said at least one passivating oxide as a thin release layer from about 50 to about 200 Åthick.

4. The method as in claim 1, wherein:

step (b) comprises forming said at least one passivating oxide by thermal oxidation of said at least one magnetic material in an $O_2$-containing atmosphere.

5. The method as in claim 1, wherein:

step (b) comprises forming said at least one passivating oxide by means of a plasma.

6. The method as in claim 5, wherein:

step (b) comprises treating said topographically patterned surface with an oxygen ($O_2$) plasma under conditions selected for minimizing deformation and/or degradation of said pattern and for an interval sufficient for facilitating release of said thicker layer of at least one magnetic material therefrom in step (d).

7. The method as in claim 5, wherein:

step (b) comprises forming said at least one passivating oxide by means of a DC, RF, or microwave plasma, or a combination thereof.

8. The method as in claim 7, wherein:

step (b) comprises exposing said topographically patterned surface to an oxygen ($O_2$) plasma.

9. The method as in claim 8, wherein:

step (b) comprises treating said topographically patterned surface with an oxygen ($O_2$) plasma under conditions selected for minimizing deformation and/or degradation of said pattern and for an interval sufficient for facilitating release of said thicker layer of at least one magnetic material therefrom.

10. The method as in claim 1, wherein:

step (a) comprises providing a substrate/workpiece comprising at least one magnetic material selected from the group consisting of: Ni, NiFe, CoNiFe, CoSiFe, CoFe, and CoFeV;

step (b) comprises forming said thin release layer as comprising at least one passivating oxide of at least one magnetic material selected from the group consisting of Ni, NiFe, CoNiFe, CoSiFe, CoFe, and CoFeV;

step (c) comprises forming a layer comprising at least one magnetic material selected from the group consisting of: Ni, NiFe, CoNiFe, CoSiFe, CoFe, and CoFeV as said thicker layer; and step (d) comprises separating said thicker layer of at least one magnetic material from said topographically patterned surface to form therefrom a magnetic stamper/imprinter including an imprinting surface having a negative image replica of said topographically patterned surface, said magnetic stamper/imprinter being usable for contact patterning of magnetic recording media.

11. The method as in claim 10, wherein:

step (b) comprises treating said topographically patterned surface of said substrate/workpiece with an oxygen ($O_2$) plasma under conditions selected for minimizing deformation and/or degradation of said pattern and for an interval sufficient for facilitating release of said thicker layer of at least one magnetic material therefrom.

12. The method as in claim 10, further comprising:

repeating steps (a)–(d) at least once, utilizing the same substrate/workpiece provided in step (a), to form at least one additional stamper/imprinter therefrom.

13. The method as in claim 10, further comprising:

utilizing the stamper/imprinter formed in step (d) as said substrate/workpiece for performing a sequence of steps (a)–(d) for manufacturing at least one additional stamper/imprinter therefrom.

14. The method as in claim 1, wherein:

step (c) comprises electroforming said thicker layer.

15. A method of manufacturing a plurality of stampers/imprinters for use in contact patterning of a magnetic recording medium, comprising sequential steps of:

(a) providing a first stamper/imprinter comprising a topographically patterned surface including a plurality of projections and depressions corresponding to a magnetic pattern including a servo pattern to be formed in a surface of a said recording medium, said topographically patterned surface comprised of at least one magnetic material having a high saturation magnetization $B_{sat} \geqq 0.5$ Tesla and a high permeability $\mu \geqq \sim 5$, selected from the group consisting of: Ni, NiFe, CoNiFe, CoSiFe, CoFe, and CoFeV;

(b) forming a thin release layer, from about 50 to about 200 Åthick, in conformal contact with said topographically patterned surface by means of a dry process, said thin release layer comprising at least one passivating oxide of said at least one magnetic material selected from the group consisting of Ni, NiFe, CoNiFe, CoSiFe, CoFe, and CoFeV; and (c) forming a thicker layer of at least one magnetic material in conformal contact with said thin release layer, said thicker layer of at least one magnetic material having a high saturation magnetization $B_{sat} \geqq 0.5$ Tesla and a high permeability $\mu \geqq \sim 5$, selected from the group consisting of: Ni, NiFe, CoNiFe, CoSiFe, CoFe, and CoFeV;

(d) separating said thicker layer of at least one magnetic material from said topographically patterned surface to form therefrom a second stamper/imprinter including an imprinting surface having a negative image replica of said topographically patterned surface, separation of said thicker layer of at least one magnetic material from said topographically patterned surface being facilitated by said thin release layer formed by said dry process, wherein: said first stamper/imprinter is a "father" and said second stamper/imprinter is a "mother", or said first stamper/imprinter is a "mother" and said second stamper/imprinter is a "son".

16. The method as in claim 15, wherein:

step (b) comprises treating said topographically patterned surface with an oxygen ($O_2$) plasma to form said thin release layer under conditions selected for minimizing deformation and/or degradation of said pattern and for an interval sufficient for facilitating release of said thicker layer of material therefrom in step (d).

17. The method as in claim 15, further comprising:

repeating steps (a)–(d) at least once, utilizing the "father" or "mother" provided as said first stamper/imprinter in step (a), to form at least one additional "mother" or "son" therefrom.

18. The method as in claim 15, further comprising:

utilizing a "mother" stamper/imprinter formed in step (d) as said first stamper/imprinter for performing a sequence of steps (a)–(d) for manufacturing at least one "son" stamper/imprinter therefrom.

* * * * *